US005113809A

United States Patent [19]

Ellenburg

[11] Patent Number: 5,113,809

[45] Date of Patent: May 19, 1992

[54] AXIAL CYLINDER INTERNAL COMBUSTION ENGINE HAVING VARIABLE DISPLACEMENT

[76] Inventor: George W. Ellenburg, 100 Oakmont La., Apt. #304, Belleair, Fla. 34616

[21] Appl. No.: 691,921

[22] Filed: Apr. 26, 1991

[51] Int. Cl.[5] ..... F02B 75/26

[52] U.S. Cl. ..... 123/58 BA; 123/48 R; 123/78 R

[58] Field of Search ..... 123/58 B, 58 BA, 58 BB, 123/58 BC, 48 R, 78 R, 78 BA

[56] References Cited

U.S. PATENT DOCUMENTS

| | | | |
|---|---|---|---|
| 2,513,083 | 6/1950 | Eckert | 123/58 BC |
| 2,957,462 | 10/1960 | Clark | 123/58 BC |
| 4,152,944 | 5/1979 | Kemper | 123/58 BA |
| 4,168,632 | 9/1979 | Fokker | 123/48 R |
| 4,294,139 | 10/1981 | Bex et al. | 123/58 B |
| 4,622,927 | 11/1986 | Wenker | 123/58 B |
| 5,007,385 | 4/1991 | Kitaguchi | 123/58 BA |
| 5,027,755 | 7/1991 | Henry | 123/58 B |

FOREIGN PATENT DOCUMENTS 2723134 11/1978 Fed. Rep. of Germany .... 123/58 B

*Primary Examiner*—David A. Okonsky

*Attorney, Agent, or Firm*—Joseph C. Mason, Jr.; Ronald E. Smith

[57] ABSTRACT

An axial cylinder variable displacement internal combustion engine. In a first embodiment, variable displacement is provided by a cylindrical sleeve that axially receives the hollow drive shaft of the engine. Plural helical slots are formed in the sleeve. Two of the helical slots slidingly receive opposite ends of a pin that carries a wobble plate and a third slot slidably receives a control pin secured to a control piston that reciprocates in response to changes in inlet manifold pressure. Displacement of the control piston thus effects rotation of the sleeve and a change in the angular and axial orientation of the wobble plate. In a second embodiment, a pair of hydraulically operated cylinders, also responsive to inlet manifold pressure, replace the slotted sleeve but perform the same function.

11 Claims, 3 Drawing Sheets

AXIAL CYLINDER INTERNAL COMBUSTION ENGINE HAVING VARIABLE DISPLACEMENT

TECHNICAL FIELD

This invention relates, generally, to improvements in means for varying the displacement and compression ratios of axial cylinder internal combustion engines.

BACKGROUND ART

Many steps have been taken to improve the fuel economy of automobile engines over the years. To obtain maximum economy, an engine must operate at the highest practical combustion temperatures and pressures. These are limited by many factors, such as the octane rating of the fuel to be used, the fuel to air ratios, the engine operating temperatures, and the temperature of the air entering the inlet manifold, and other less important items. These combustion temperatures are now at their practical upper limits during full throttle operation, which operation represents a very small percentage of total operating time for the average driver. Since a large displacement engine is needed for power at low engine rpm and for accelerating, these large engines have been provided in the past. However, to meet present economy requirements, small displacement engines operating at high rpm to deliver the power required are now in use. They often need superchargers and four valves per cylinder to maintain an acceptable torque at high engine rpm. A multispeed transmission is also needed, but all of these improvements are expensive and provide only modest economy gains. Basically, the present engines are at the practical limit in fuel economy.

The obvious answer to the fuel economy problem is to use a variable displacement engine that operates most of the time in a small displacement mode at near peak efficiency, and which quickly shifts to maximum displacement when high power is required.

Engineers have long recognized the need for a variable displacement engine to obtain a substantial gain in fuel economy and the performance demanded by the majority of users.

Equally important is the pollution problem, which a variable displacement engine would reduce in two ways, i.e., by burning less fuel, and burning the fuel that is consumed in a narrow band of high pressure and temperature.

Therefore, many variable displacement and compression ratio engines have been designed. It is believed that the axial cylinder engine is the only practical design that permits easy displacement change during engine operation.

A good summary and discussion of these engines is found in a publication by E. S. Hall, entitled "Engines Having Cylinders Parallel to the Shaft," published by The Round Engine Patents, New York City.

A variable displacement or variable compression ratio engine is shown in U.S. Pat. No. 4,077,269 to Hodgkinson. The mounting of the swash plate of that device permits variation of its angular orientation to the drive shaft to thereby vary the piston stroke and also permits axial movement to control the compression ratio.

Another variable stroke axial cylinder engine is shown in U.S. Pat. No. 4,294,139 to Bex, et. al.

Still another variable stroke, variable compression ratio engine is shown in U.S. Pat. No. 3,319,874 to Walsh, et. al.

A German patent no. 3043251 to Baye also shows a swash plate engine.

U.S. Pat. No. 3,319,874 shows a means of restraining the wobble assembly that keeps the connecting rods from rotating with the shaft. However, that device can not be balanced due to the variation of the length of the restraint arm, which is radially disposed to slide on an axially disposed straight fixed rod.

Thus, the art is well developed, but despite the acknowledged superiority of a variable displacement engine, none are on the road today. This lack of acceptance is attributable to the heretofore proposed designs' inability to meet the displacement change rates desired for automotive use. Specifically, none of the designs heretofore proposed are able to change from the minimum displacement mode to the maximum at a very fast, but controllable rate when full power is required as for rapid acceleration, and conversely are unable to change to the low displacement mode at a smooth controlled rate when little power is needed.

Equally important is accurate balance. Earlier axial cylinder engine designs, if they addressed balance at all, were of doubtful accuracy over the range of displacement changes and were overly complicated in structure and difficult to manufacture. Furthermore, none of the earlier designs appear to be designed for easy production. Thus, high cost would be another factor against acceptance.

There is a great need, therefore, for an improved axial cylinder variable displacement engine. More specifically, the improved engine would be free of all deficiencies mentioned above, i.e., it would be controllable for the rates of change in displacement required, be balanced over the range of displacements, and most importantly it would have an economically feasible design.

However, the prior art when taken as a whole neither teaches nor suggests how such an acceptable engine could be provided.

DISCLOSURE OF INVENTION

The main object of this invention is to provide an axial cylinder engine having improvements in the means for varying the displacement and compression ratios, the means of balance, and to provide a design that can be easily produced.

Two embodiments of the invention are disclosed. In each, a wobble ring assembly has an inner ring rotating conjointly with the shaft and which is coupled to an outer ring by a ball bearing capable of handling both axial and radial loads. This eliminates the high friction losses inherent to a wobble plate design, and therefore permits a shorter stroke by lowering the minimum angle of the wobble ring to the shaft.

The outer ring is restrained from rotation by a simple and novel method that can be balanced, and also permits the net engine torque to be obtained therefrom.

Both embodiments are designed so that engine piston forces from combustion pressures provides the energy to change to the large displacement mode rapidly and the control pistons disposed circumferentially around the shaft can have ample area to utilize a low pressure fluid system, to change to the low displacement mode, thus eliminating the need for a high pressure, high capacity fluid pump.

The primary objects of this invention are to provide improvements in the means for varying the displacement and compression ratios of axial cylinder engines, the means of balance in said engines, and to provide a design that can easily be manufactured.

These and other important objects, advantages, and features of the invention will become apparent as this description proceeds.

The invention accordingly comprises the features of construction, combination of elements and arrangements of parts that will be exemplified in the construction set forth hereinafter and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

Similar reference numerals refer to similar parts throughout the several views of the drawings.

BEST MODES FOR CARRYING OUT THE INVENTION

Figures 1, 1A, 1B, 2, 2A, 2B, 2C:
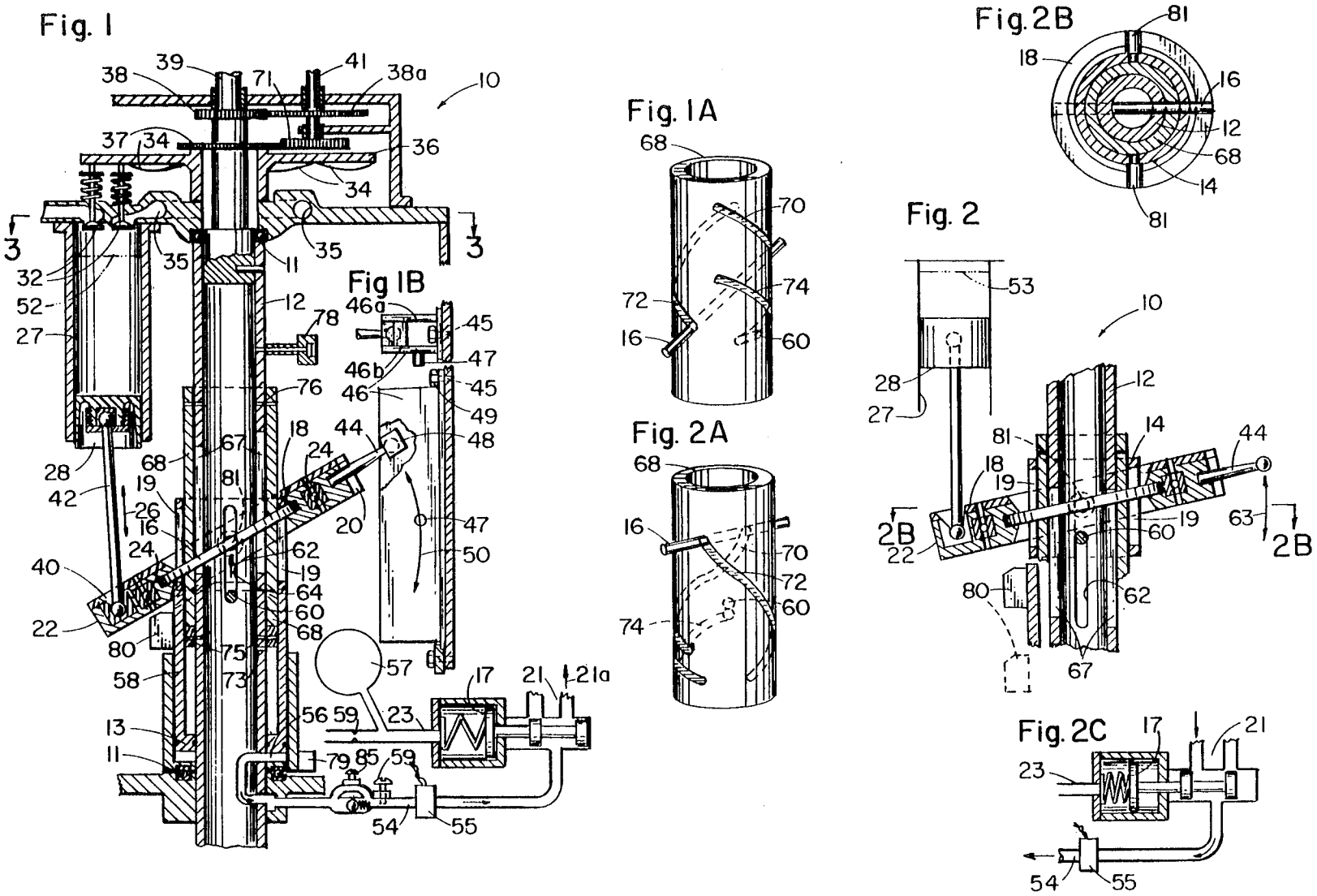
FIG. 1 is a sectional view of an exemplary embodiment of the novel axial cylinder engine shown in the maximum displacement mode.
FIG. 1A is a perspective view of the helices in the cylinder that control the axial and angular position of the wobble ring assembly by the action of the large pin that supports said ring through the helical grooves in the cylinder.
FIG. 1B is a top plan view of the parts that constrain the outer ring against rotation with the inner ring.
FIG. 2 shows only the relevant parts of the novel mechanism in the minimum displacement mode.
FIG. 2A is a perspective view of the helical grooves in the minimum displacement mode.
FIG. 2B is a sectional view taken along line 2B—2B in FIG. 2.
FIG. 2C is a sectional view of an alternate control means.

Referring now to FIG. 1, it will there be seen that the first embodiment of the invention is denoted as a whole by the reference numeral 10. Engine 10 is shown without the complete outer structure, fly wheel, ignition system and other normal accessories to simplify the drawing and illustrates a feasible basic axial cylinder engine in which the improved mechanisms for changing the displacement and related compression ratios can be readily adapted. Anti-friction bearings 11 are positioned at all highly loaded areas, thereby reducing friction losses.

While this engine is illustrated with the shaft disposed in a vertical plane, it can be operated in any attitude, most likely with the shaft horizontal, or nearly so. "Top," as used hereinafter, will therefore refer to the top of the drawing, for ease in description thereof.

For ease of balance, compactness and manufacture, the majority of the parts are bodies of revolution and where possible, concentric with hollow drive shaft 12. The light weight cylinders 27 are identical units, with their own cooling systems, not shown, and can be cantilevered to the head assembly as shown in FIG. 1, as there are no significant side forces from the pistons due to the very small angularity of the connecting rods. Also note that accurate parallelism with the shaft axis is not required, so precision is not needed in the attachment method. The arrangement of cylinders 27 with respect to shaft 12 is perhaps best understood in connection with FIG. 3.

By eliminating the usual heavy cylinder block, with its requirement for exact cylinder positioning and alignment with the crank shaft, significant savings in manufacturing costs and weight over present engine art is effected.

Figure 3:
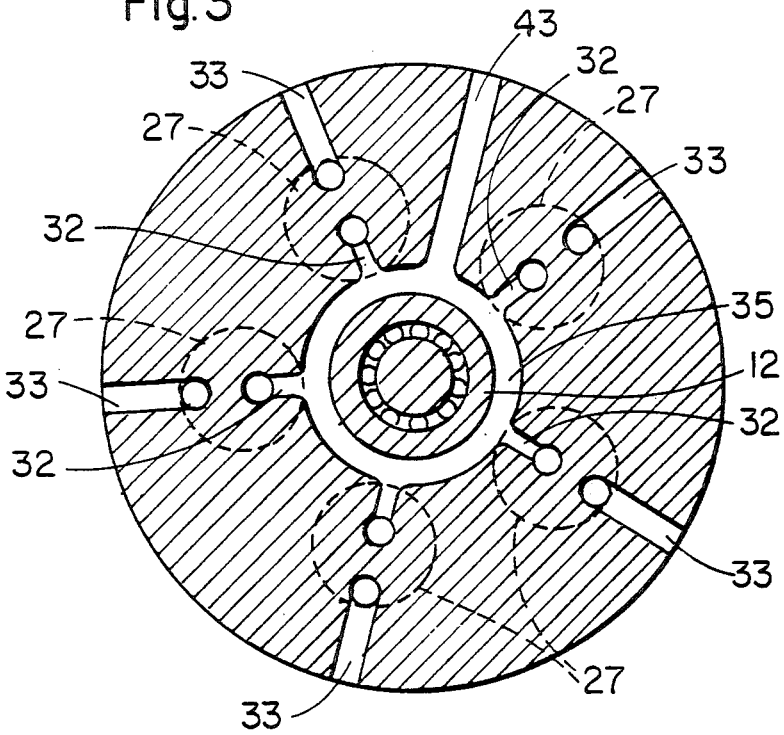
FIG. 3 is sectional view taken along line 3—3 in FIG. 1 to show the cylinder arrangement, intake for fuel and air, and the induction manifold and exhaust ports.

It should be understood from the outset that inner ring 18 rotates conjointly with drive shaft 12 and that outer ring 22 does not rotate. Outer ring 22 wobbles in the manner suggested by double-headed directional arrow 50; said wobble is caused by the reciprocating motion of pistons 28 in cylinders 27, as indicated by the double-headed directional arrow 26, which are conventionally valved by intake and exhaust valves, collectively denoted 32. The intake and exhaust valves are cammingly engaged by lobes 34 formed on a unique disk cam 36 having drive gear 37. Power take off shafts 39 and 41, also conventional, provide power to the ignition system and accessory loads, in the well known way. Reduction gears 38 and **38*a* are for the distributor and ignition systems, and numeral 71 is a reduction gear as well. It should be understood that the number of cylinders 27 and associated parts is preferably five, but seven or nine would be used for greater power and smoothness, depending upon the application. FIG. 1 shows but one cylinder to simplify the drawing. FIG. 3 shows a five cylinder arrangement, which is believed to be the most cost effective arrangement. In FIG. 3, the reference numeral 33 denotes the cylinder exhaust ports, collectively, numeral 35 indicates the air intake manifold, if fuel injection is used, or the fuel and air intake manifold if a carburetor is used, and numeral 43** indicates the manifold inlet port.

The means for accurately controlling the displacement and compression ratio to the desired values over the range desired includes a novel, multi-slotted cylinder, 68, best shown in FIGS. 1A and 2A. This cylinder snugly receives drive shaft 12 as shown in FIG. 1 but is free to rotate thereon. Axial restraint rings 75 and 76 are disposed at opposite ends of cylinder 68.

Rigid pin 16 passes through diametrically opposed slots 67 in the shaft 12, through helices 70 and 72 formed in cylinder 68, and its opposite ends are fixed but free to rotate in the inner wobble ring 18. Pin 16 serves to control the angular and axial position of the wobble ring assembly as determined by the slope of the helices 70 and 72, and through the angular rotation of cylinder 68 about the shaft 12, it thus controls the displacement and compression ratio. This can best be illustrated by comparing FIG. 1A, which shows the position of pin 16 for maximum displacement, with FIG. 2A, which shows the position of said pin for minimum displacement. Note that in FIG. 2A, a second pin 60 has moved upward from its position in FIG. 1A to rotate cylinder 68 counterclockwise by the maximum amount, thereby placing pin 16 in the position for minimum displacement as shown in FIGS. 2 and 2A.

Pin 60 is fixed in a rear extension of cylinder 58 and is constrained to axial movement by slot 62 in shaft 12. Thus, as piston 13 (lower left corner of FIG. 1), with attached cylinder 58, is forced upward by fluid pressure in cavity 56, action of pin 60 on helix 74 (FIGS. 1A and 2A) causes counterclockwise motion of cylinder 68. Note vent 73 for piston 13 as it moves upwardly. In the claims that follow, piston 13 and cylinder 58 secured thereto are collectively referred to as the control piston.

There are certain design conditions that must be met for balance purposes. Since the variation in stroke is not proportional to the axial movement of pin 60, helix 74 must be modified slightly from a true helix to insure this linearity. The reason will become more apparent during the discussion on balance.

Outer ring 22 is restrained from rotation by radially extending arm 44, which has split bearing shoe 48 on its ball-shaped end. This shoe is free to move in channel 46, which has a pair of transversely spaced apart, smooth and parallel inner walls 46*a*, 46*b* (FIG. 1B). The arcs of motion of shoe 48 vary from the maximum as indicated by double-headed directional arrow 50, to arc length 63 (FIG. 2) for the minimum stroke. The average force to restrain is proportional to the net torque the engine delivers. A feature of this design is that the net torque can be determined easily. By hinging the upper end of channel 46 by bolt 45, and providing a suitable mount at the lower end that permits a small circumferential movement, a transducer can be mounted on projection 47 (FIG. 1B) to a fixed point on the engine structure to produce an electrical potential which can be calibrated to measure the average net torque. This feature has not been observed on any other axial cylinder engine design and can be most useful in development and as a control factor, especially for diesels, where the throttle only controls the fuel admitted, and does not vary the manifold pressure.

Figure 4:
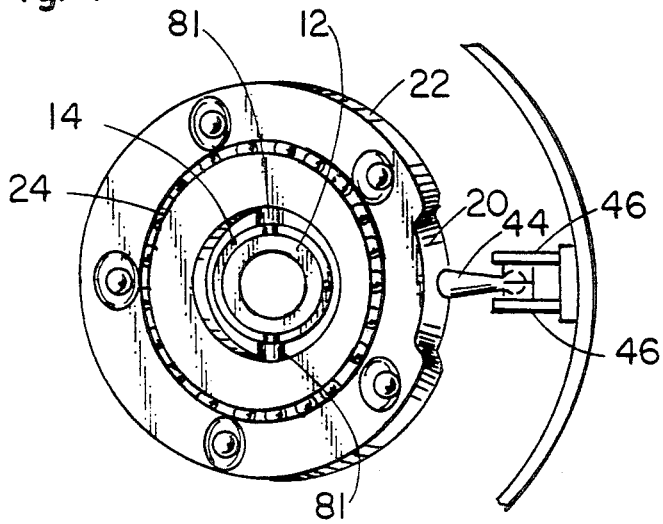
FIG. 4 is a top plan view of the wobble ring assembly at its maximum displacement mode; it illustrates the restraint feature and shows the trunnions that center and provide an axis for the wobble ring assembly.

Another advantage of this restraint method is that it can easily be balanced accurately by removing mass from ring 22 at the base of arm 44, i.e., the area denoted by numeral 20, FIG. 1 and as best shown in FIG. 4. The wobble ring must be stabilized about the axis of pin 16, so with reference to FIG. 2B, note that trunnions 81 (also shown in FIGS. 2 and 4) are cantilevered from the inner wobble ring 18, bridge the clearance space and fit into diametrically opposite bearings in sleeve 14. This both stabilizes the wobble ring in the proper plane and provides an axis for angular movement and also centers inner ring 18 with respect to the shaft axis. Sleeve 14 is slidably disposed on cylinder 68 to accommodate the axial shift occurring and is slotted at diametrically opposed areas 19 to allow the angular orientation of pin 16 to vary.

Those skilled in the mechanical arts will appreciate that the wobbling of outer ring 22, imparted by piston forces through connecting rods 42, will, through ball bearing 24, effect a like action on inner ring 18, causing it to rotate. Pin 16, with its opposite ends fixed in said inner ring 18, diametrically extends through slots 67 in the shaft 12, thus causing said shaft to rotate conjointly with said pin. By this system of wobble rings and the ball bearing 24, the reciprocating motion of pistons 28 is converted to rotary motion of shaft 12 with minimum friction losses, as the conventional piston side forces, the connecting rod end bearing and main crank shaft bearing friction losses have been eliminated by ball bearings 11 and 24. The basic balance of cylinder 68, and concentric cylinder parts, is conventional. However, a novel means is employed for the balance of pistons, rods, and outer wobble ring 22. Desirably, this outer ring should have added mass in the areas between the connecting rod bearings 40 to insure a uniform effective mass around this ring. During rotation, an unbalanced couple is caused by the mass of the pistons and the outer ring in proportion to the stroke. This is partially offset by the small opposing couple caused by the mass of the rotating inner ring 18. Accordingly, the net unbalanced couple must be balanced by an equal and opposite couple, also varying in proportion to the stroke.

The arm for the balance couple for maximum stroke is chosen as the length of the maximum stroke; the mass of balance weight 80 is then calculated. The position of the other weight for this couple falls in an axial position such that it is about at the ball bearing denoted 24. The weight must therefore be split to avoid interference with the wobble ring assembly. Thus the weight is split, with two-thirds placed above the desired position at 78, and one-third placed at 79 (bottom of FIG. 1), twice as far below the desired position, thus having an effective weight at the proper place without interference with the wobble ring assembly. Since the axial movement of weight 80 is, by design of helix 74, exactly equal to the difference in maximum to minimum stroke, the balance for minimum stroke is correct. Furthermore, since the axial movement of weight 80 is designed to be proportional to the stroke, intermediate transitional balance is correct over the range of strokes from maximum to minimum. In the claims that follow, weights 78 and 79 are referred to as the first and second weight members, and weight 80 is referred to as the third weight member.

Having described the mechanical operation of the invention, a control system will now be described. Again with reference to FIG. 1, the engine is shown in the position for maximum displacement. The throttle is moved to reduce power, and when the manifold pressure drops below the design threshold, which should be about twenty-six inches of mercury, control piston 17 (lower right) moves from the position shown in FIG. 1 to the position shown in FIG. 2C. Orifice 59 in manifold pressure line 23, in connection with accumulator 57 may be needed to insure that inadvertent throttle movements do not cause unnecessary shift in displacement, as such devices tend to dampen changes in the manifold pressure, as is well known to those experienced with pneumatic control systems. Valve 21, FIGS. 1 and 2C, now allows fluid under pressure to enter line 54 and hence into valve 85 (bottom center of FIG. 1), closing a check valve in 85 and forcing a small flow, as controlled by the orifice in 85, into space 56 under piston 13, forcing said piston to move slowly upward. Since pin 60 is fixed to a rear extension of cylinder 58 on piston 13, the axial motion of pin 60 causes cylinder 68 to rotate counterclockwise, through the action of helix 74. Thus, the displacement is changed at a smooth, slow rate to the position shown in FIG. 2. Comparing FIGS. 1 and 2, note both the axial and angular position of outer ring 22 has changed to both shorten the stroke and change the compression ratio by changing the clearance space at the top of the piston stroke from 52 (FIG. 1) to the minimum displacement position denoted by line 53, FIG. 2. Also note that the minimum displacement mode has a piston stroke that is shorter than the bore of the cylinder, for minimum heat loss and reduced piston surface speed on the cylinder. Since the engine operates only a small portion of operating time in the maximum displacement mode, the long stroke, small bore configuration with its attendant inefficiencies is acceptable.

When a demand for high power occurs, the throttle is opened and the manifold pressure exceeds its upper design threshold limit of about twenty-eight inches of mercury. Piston 17 moves to the position shown in FIG. 1, allowing the fluid holding piston 13 up for small displacement to return to the reservoir as indicated by directional arrow 21*a*. Thus, the check valve in 85 opens quickly and the combustion pressure, i.e., the engine combustion forces on the pistons 28 forces the engine into the maximum displacement mode very rapidly in the absence of a high volume and high pressure pump. Thus, energy is saved because such pumps, as used in automotives, constantly pump fluid through the pressure relief valve so that high pressure is available when needed, as for power steering. Note accumulator 57 and orifice 59; these dampen changes in manifold pressure when the throttle is subjected to movement spikes of the type generated when the foot of a nervous driver jiggles said throttle.

It should be noted that the displacement can be locked at any intermediate value by activating the pressure balanced solenoid operated valve 55.

A fully electronic control system may also be used, including a transducer in the manifold pressure line to activate a solenoid to operate valve 21, and valve 55 as desired. Moreover, torque, instead of manifold pressure, could be used to determine the position of valve 21, particularly in the case of diesels, which operate without varying the manifold pressure and which need the extra displacement primarily to avoid pollution at high powers, i.e., high torque.

Figures 5, 5A, 6, 6A, 6B:
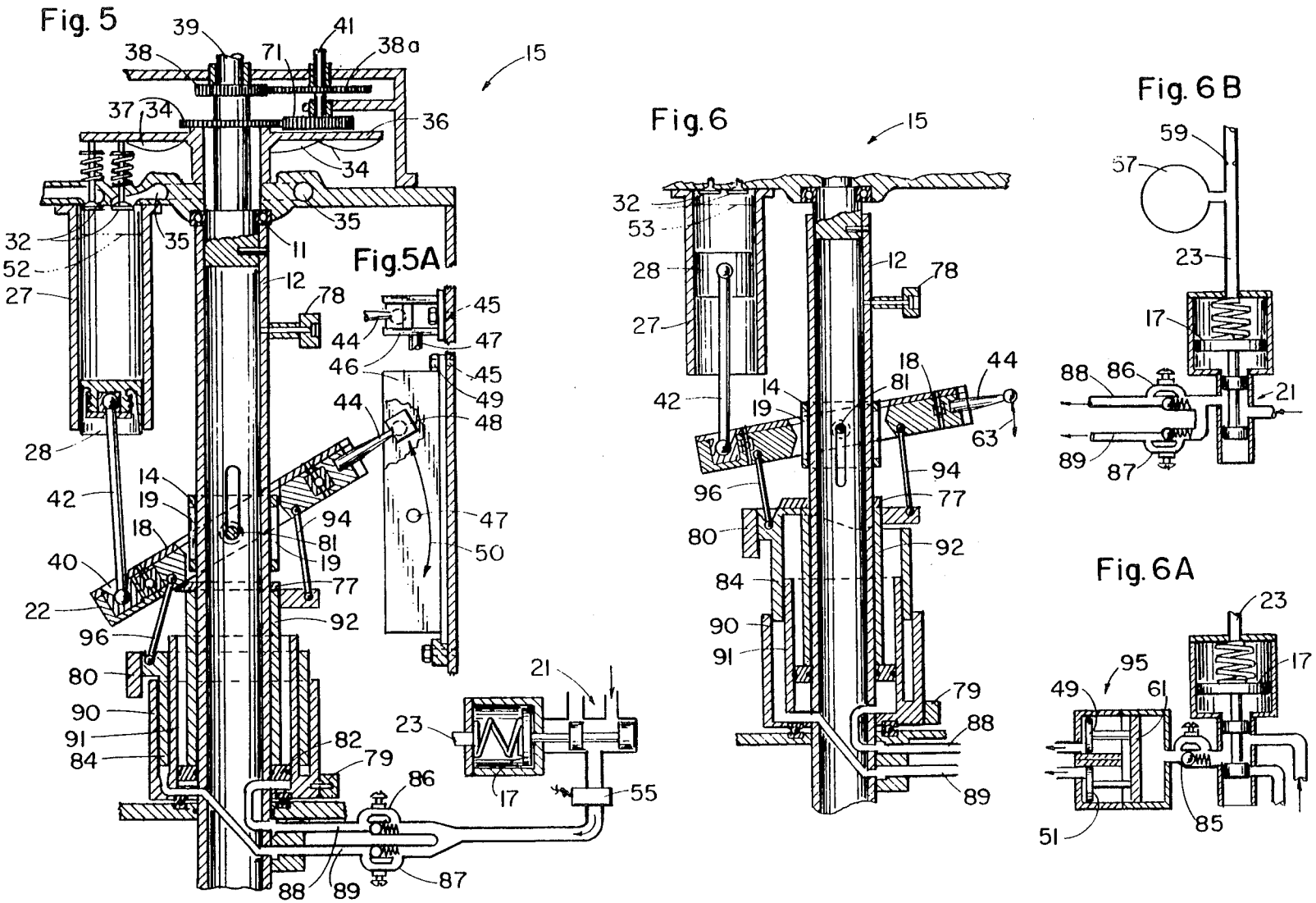
FIG. 5 is a sectional view of the second embodiment at its maximum displacement mode.
FIG. 6 is a sectional view of the relevant parts in the minimum displacement mode.
FIG. 6A depicts a slave and master cylinder arrangement that meters exactly equal amounts of fluid to the inner and outer cylinders of the second embodiment.
FIG. 6B shows the same control means as in FIG. 5, but also includes an accumulator and an orifice means for dampening spikes in changes in manifold pressure.

Referring now to FIG. 5, a sectional view of the second embodiment is denoted as a whole by the numeral 15 and is shown without the complete outer structure, fly wheel, ignition system and other normal accessories to simplify the drawing. Note that many parts are similar to those in FIG. 1 and are denoted with the same reference numerals if said parts share a common function. However, such parts may not be interchangeable.

Again, for ease of balance, compactness and ease of manufacture, most major parts are bodies of revolution and where possible, are concentric with the shaft. In this design the angle and axial displacement of the wobble ring is accomplished by the direct action of an annular piston 82 which abuttingly engages the lowermost end of extension sleeve 92, and by sleeve piston 84 with the counter balance weight 80 attached. Both have suitable structures attached at the top to receive the link rods 94 and 96. The walls for these pistons are shafts 12 and 91 for the inner piston 82 and 90 and 91 for the outer piston.

Comparing FIG. 5 and FIG. 6, it is apparent that these pistons must move different axial lengths to move the wobble ring from its minimum to maximum displacement position. This is accomplished by having the volume of each the same at maximum extension, the position of minimum displacement (FIG. 6). The areas are carefully proportioned for this purpose. Thus, when an equal volume of fluid is introduced into each cylinder, said pistons extend to their common stop, 77. Suitable lower stops, not shown, are also provided.

There are two means for simultaneously supplying the same volume of fluid to these cylinders. The simplest is shown at the bottom right of FIG. 5. Manifold pressure activated valve 21 delivers the fluid to a "Y" connection, then into two check valve-orifice assemblies 86 and 87 for inner piston 82 and outer piston 84, respectively. These orifices are adjusted to meter the correct volume of fluid so that the pistons reach the stop 77, preferably with sleeve extension 92 slightly lagging piston 84, to avoid exceeding the limits for the compression ratio during transition from maximum to minimum stroke, thus avoiding possible "knock." In the claims that follow, sleeve extension 92 is included in the term inner piston. The orifices may not meter the exact amount of fluid to the cylinders, as the force on link rods 94 and 96 will be different as affected by the combustion forces on pistons 28. There is an offsetting effect as inner piston 82 has the largest area and the largest force on it, so the difference in back pressure on the orifices may have little effect on the rates of flow.

Should the simple orifice system not be accurate enough, especially if intermediate displacements are to be used by activating solenoid valve 55, an alternate exact system is provided. With reference to FIG. 6A, a master cylinder assembly 95 includes master piston 61 which moves two small slave pistons 49 and 51 in equal sized slave cylinders the exact distance, so exact amounts of fluid can be provided through lines 88 and 89, thus insuring the correct compression ratio for all displacements during transition. This arrangement provides exact metering of fluid to the inner and outer control pistons. An advantage of this system is that a very low pressure control fluid can be introduced through valve 21 as the area of piston 61 can be made much larger than the combined areas of pistons 49 and 51, thereby gaining a pressure increase. Note in FIG. 6B that accumulator 57 and orifice 59 are provided to dampen manifold pressure when a nervous foot jiggles the throttle.

This discussion on the novel control system is only to show that the engine can be controlled at the necessary rates, from very fast, i.e., less than one second, from minimum displacement to maximum to very slow from maximum to minimum, i.e., several seconds.

The art for similar controls is well developed for automatic transmissions, both hydraulic and electric.

It should be noted that with this invention, most applications will need only a two speed transmission as the torque range of this engine is large; this enables a further cost reduction relative to present art.

The wobble ring restraint system of this second embodiment is the same as described for the first embodiment.

The balance system for the second embodiment is the same in principle as described for the first embodiment. However, in the second embodiment it is apparent that the length of axial travel of balance weight 80 is limited and is less than the difference in the maximum and minimum strokes. Thus, to obtain the couple arm to calculate the mass of weight 80 to balance the engine at maximum stroke, it is necessary to multiply the ratio of this reduced length of travel to the desired length, the maximum—minimum stroke, by the length of maximum stroke. This will produce a shorter arm, and therefore an increase in mass for all weights; however, the reduced movement from maximum to minimum mode moves weight 80 the exact distance required to balance the engine at minimum displacement, as all the relationships are linear. Accordingly, the same simplicity of balance means is maintained.

This invention is clearly new and useful. Moreover, it was not obvious to those of ordinary skill in the art at the time it was made, in view of the prior art when considered as a whole.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What I claim is:

1. An axial cylinder variable displacement internal combustion engine, comprising:

a hollow, rotatably mounted drive shaft;

a wobble assembly including an inner wobble ring mounted for rotation and a non-rotatably mounted outer wobble ring;

said inner wobble ring being centrally apertured to axially receive said drive shaft;

said inner wobble ring being keyed to said drive shaft for conjoint rotation therewith;

said outer wobble ring being mounted in coplanar relation to said inner wobble ring;

annular low friction means for interconnecting said inner and outer wobble rings;

balanced anti-rotation means for preventing rotation of said outer wobble ring and for permitting wobbling motion of said inner wobble ring;

an odd number of cylinders having their respective axes of symmetry disposed in substantially parallel relation to said drive shaft;

a slidably mounted engine piston being disposed in each of said cylinders;

valve means associated with each of said cylinders for controlling operation of said engine;

a connecting rod interconnecting each of said pistons to said outer wobble ring;

each of said connecting rods having a first end swivelly connected to an associated piston and a second end swivelly connected to said outer wobble ring;

a cylindrical sleeve member axially receiving said drive shaft;

first, second, and third helical slots being formed in said sleeve member;

a first axially extending slot formed in said drive shaft;

a first linear in configuration pin member extending diametrically through said first axially extending slot and said first pin member having opposite ends fixedly secured in said inner wobble ring;

said first pin member opposite ends extending through said first and second helical slots;

a control piston that telescopically receives said drive shaft member and which abuts a preselected end of said cylindrical sleeve member;

hydraulic means for effecting axial travel of said control piston;

a second axially extending slot formed in said drive shaft;

a second pin member having opposite ends extending through said third helical slot;

said second pin member extending through said second axially extending slot;

whereby said second pin member is constrained to axial movement by said second axially extending slot, so that when said hydraulic means is activated, said second pin member travels in said third helical slot and rotates said sleeve member, and whereby said first pin member, being constrained to axial movement by said first axially extending slot, rides in said first and second helical slots when said sleeve member is rotated by said second pin member, said first pin member when riding in said first and second helical slots thereby changing the axial and angular position of the wobble ring assembly relative to said drive shaft.

2. The engine of claim 1, wherein said anti-rotation means includes a rigid arm member having a first end fixedly secured to said outer wobble ring, said arm member extending radially from said outer wobble ring in coplanar relation thereto, said arm member having a second end, a friction-reducing bearing shoe being secured to said second end, and said bearing shoe being mounted for oscillation between a pair of parallel, transversely spaced apart channel-defining members, said channel-defining members constraining said bearing shoe to oscillate along a plurality of arcuate paths of travel in a plane extending through the axis of rotation of said drive shaft, said channel-defining members being mounted on a non-rotatably mounted side wall of a housing for said engine.

3. The engine of claim 2, said channel-defining members being pivoted at a preselected end thereof and having at least some movement in a tangential direction at a second end thereof so that a transducer may be placed near the center thereof to read torque as an electrical potential.

4. The engine of claim 1, further comprising means for balancing said engine, said balancing means including first and second weight members extending radially outwardly from said drive shaft in a first radial direction, said first and second weight members being axially spaced with respect to one another to produce an effective weight at a proper, predetermined axial position, and a third weight member integral to said control piston that extends radially outwardly from said control piston in diametric opposition to said first and second weight members, whereby said first, second, and third weight members provide a linearly adjustable balance couple in opposition to a unbalance couple produced by said engine pistons and wobble assembly operation.

5. The engine of claim 4, wherein said hydraulic means is responsive to changes in inlet manifold pressure of said engine and wherein said control piston is axially retracted when said inlet manifold pressure is low and axially extended when said inlet manifold pressure is high.

6. The engine of claim 5, wherein a predetermined mass of said outer wobble ring is removed in the vicinity of said rigid arm member to compensate for the weight of said arm member to thereby maintain the balance of said engine.

7. An axial cylinder internal combustion engine, comprising:

a hollow, rotatably mounted drive shaft;

an inner wobble ring that is centrally apertured to axially receive said drive shaft;

said inner wobble ring being conjointly rotatable with said drive shaft;

an outer wobble ring coplanar with said inner wobble ring;

annular low friction means for interconnecting said inner and outer wobble rings;

anti-rotation means for preventing rotation of said outer wobble ring and for permitting wobbling motion of said inner and outer wobble rings;

an odd number of cylinders having their respective axes of symmetry disposed in substantially parallel relation to said drive shaft;

a slidably mounted piston being disposed in each of said cylinders;

valve means associated with each of said cylinders for controlling operation of said engine;

a connecting rod interconnecting each of said pistons to said outer wobble ring;

each of said connecting rods having a first end swivelly connected to an associated piston and a second end swivelly connected to said outer wobble ring;

an inner piston that is centrally apertured and that axially and slidably receives said drive shaft;

an outer piston that is centrally apertured and that telescopically receives said inner piston;

said inner and outer pistons being concentrically disposed with respect to one another and with respect to said drive shaft;

first hydraulic means, responsive to changes in inlet manifold pressure, for activating said inner piston;

second hydraulic means, responsive to changes in inlet manifold pressure, for activating said outer piston;

a first swivelly mounted, rigid, linear in configuration link member disposed in interconnecting relation to said inner wobble ring and said outer piston;

a second swivelly mounted, rigid, linear in configuration link member disposed in interconnecting relation to said inner wobble ring and said inner piston; and wobble ring mounting means permitting axial displacement of said inner wobble ring and hence of said outer wobble ring with respect to said drive shaft;

means for delivering to said inner and outer pistons an equal volume of fluid;

each piston of said inner and outer piston traveling axially a distance inversely proportional to its area when activated by said fluid;

whereby said inner and outer pistons travel unequal distances in response to equal amounts of activating fluid, said inner and outer pistons having preselected areas such that they have equal volumes when fully extended; and whereby relative motion between said inner and outer pistons changes the common angular disposition of said inner and outer wobble rings with respect to the axis of rotation of said drive shaft.

8. The engine of claim 7, wherein said anti-rotation means includes a rigid arm member having a first end fixedly secured to said outer wobble ring, said arm member extending radially from said outer wobble ring in coplanar relation thereto, said arm member having a second end, a friction-reducing bearing shoe being secured to said second end, and said bearing shoe being mounted for oscillation between a pair of parallel, transversely spaced apart channel-defining members, said channel-defining members constraining said bearing shoes to oscillate along a plurality of arcuate paths of travel in a plane extending through the axis of rotation of said drive shaft, said channel-defining members being mounted on a non-rotatably mounted side wall of a housing for said engine.

9. The engine of claim 8, wherein said channel-defining members are pivoted at a preselected end thereof and have at least some movement in a tangential direction at a second end thereof so that a transducer may be placed near the center thereof to read torque as an electrical potential.

10. The engine of claim 9, further comprising means for balancing said engine, said balancing means including first and second weight members extending radially outwardly from said drive shaft in a first radial direction, said first and second weight members being axially spaced with respect to one another to produce an effective weight at a proper axial position for a predetermined arm, and a third weight member integral to said control piston that extends radially outwardly from said control piston in diametric opposition to said first and second weight members, whereby said first, second, and third weight members provide a linearly adjustable balance couple in opposition to an unbalance couple produced by said engine pistons and wobble assembly operation.

11. The engine of claim 10, wherein said first and second hydraulic means includes means in open communication with inlet manifold pressure of said engine and means for actuating said first and second pistons in response to changes in said inlet manifold pressure, said first and second pistons being fully retracted when inlet manifold pressure is less than a minimum design pressure and said first and second pistons being fully extended when inlet manifold pressure is greater than a maximum design pressure, said inner and outer wobble rings having their common maximum angular disposition with respect to said drive shaft at said maximum level and having their common minimum angular disposition at said minimum level.

* * * * *